United States Patent [19]

Johnson

[11] 4,184,501

[45] Jan. 22, 1980

[54] SOLAR SHIELD

[76] Inventor: Bernard L. Johnson, 6431 Girvin Dr., Oakland, Calif. 94611

[21] Appl. No.: 910,525

[22] Filed: May 30, 1978

[51] Int. Cl.[2] ..... A45F 1/16

[52] U.S. Cl. ..... 135/1 A; 135/3 A; 135/5 A; 135/7.1 A; 135/15 CF; 135/15 PQ; 135/DIG. 1

[58] Field of Search ..... 135/5 A, 4 A, 3 A, 1 A, 135/6, 15 CF, 7.1 A, DIG. 1; 296/136; 5/113, 121, 362

[56] References Cited

U.S. PATENT DOCUMENTS

| | | | |
|---|---|---|---|
| 1,061,547 | 5/1913 | Kennedy et al. | 135/15 CF |
| 1,519,691 | 12/1924 | Mizrahi | 135/6 |
| 2,493,833 | 1/1950 | Reynolds | 135/6 |
| 3,995,649 | 12/1976 | Robichaud | 135/4 A X |

FOREIGN PATENT DOCUMENTS

| | | | |
|---|---|---|---|
| 89329 | 5/1958 | Netherlands | 135/4 A |
| 149618 | 4/1955 | Sweden | 135/5 A |

*Primary Examiner*—C. J. Husar
*Assistant Examiner*—Conrad Berman
*Attorney, Agent, or Firm*—George B. White

[57] ABSTRACT

A flexible shield material having the characteristic of not transmitting solar heat, is supported on a frame which extends from end to end of an automobile or the like vehicle and is adjustable in length, having means on the opposite ends to be hooked to the front and rear bumpers and adapted to be locked, the longitudinal frame members including telescopic members so that the entire frame can be collapsed to a size adapted to be stored in the trunk of the average vehicle, and when extended space the sun shield from the vehicle body.

6 Claims, 13 Drawing Figures

SOLAR SHIELD

BACKGROUND OF THE INVENTION

Automobile sun shades and sun protectors are shown in prior patents such as U.S. Pat. Nos. 2,496,085; 2,508,757 and 2,571,362. Canadian Pat. No. 692,827 shows a pleated collapsible cover for furniture and the like.

None of the prior patents of which applicant is aware shows any efficient sun shielding, flexible material, nor a telescopic frame which would permit the collapsing of the sun shield to a size to be stored in the trunk of an automobile, and which can be easily extended over the automobile in such a way that the frame spaces the entire shield from the body of the automobile thereby to provide an insulating air space between the shield and the parts of the body of the automobile to be shielded.

BRIEF DESCRIPTION OF THE PREFERRED FORM OF THE INVENTION

Figure 1:
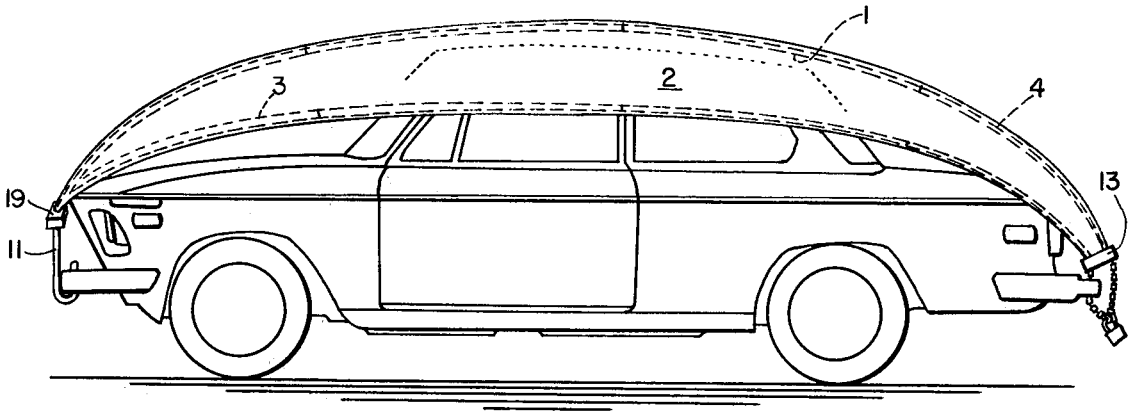
FIG. 1 is a side view of an automobile with the sun shield in place thereon.
Figure 2:
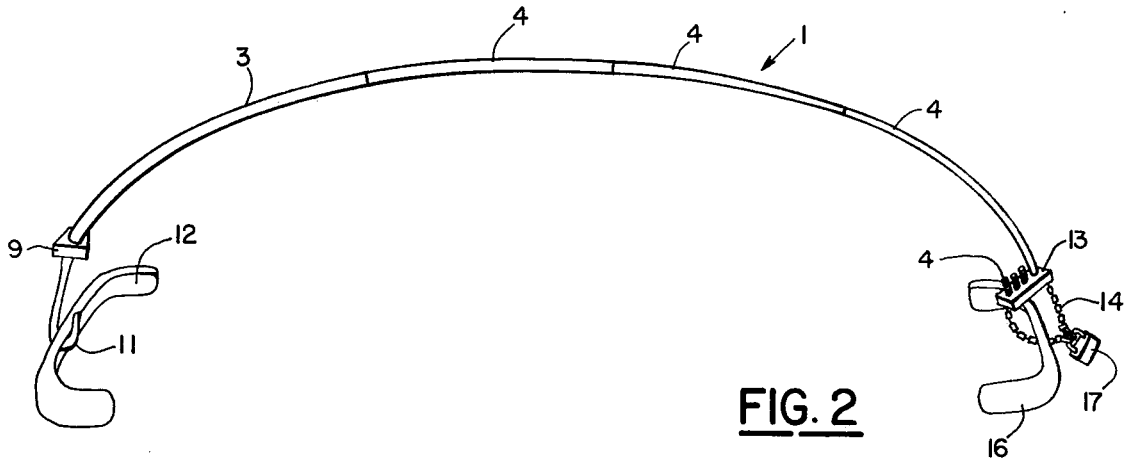
FIG. 2 is a view of a single telescopic spacer element in operating position.
Figure 3:
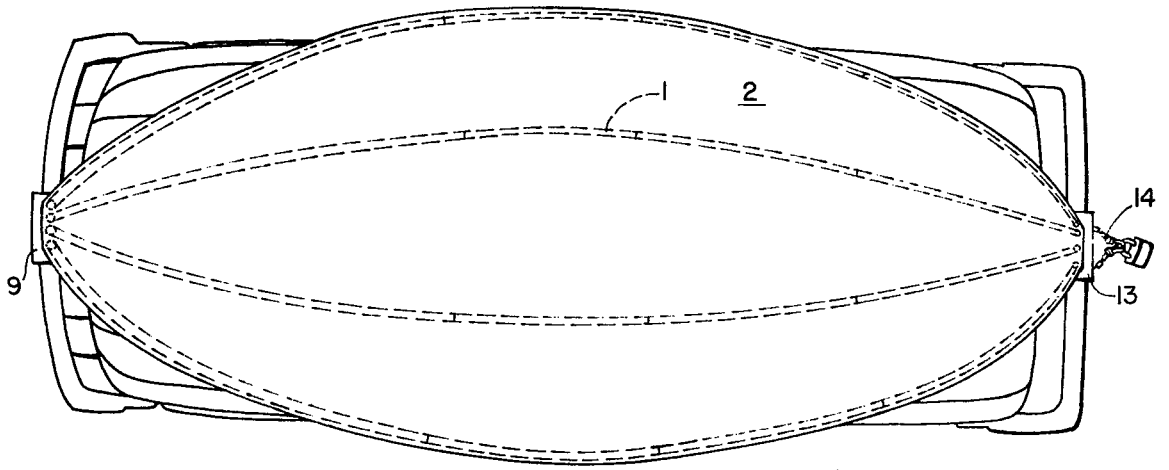
FIG. 3 is a plan view of the sun shield of the automobile.
Figure 4:
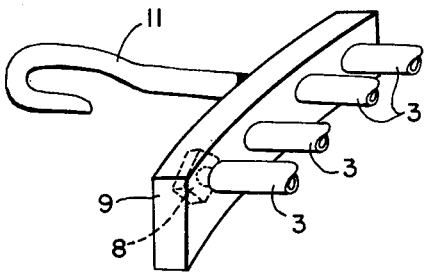
FIG. 4 is a perspective view of the hook end of the spacer frame.

The temporary covering for an automobile has the ability to reflect heat and harmful sunrays away from the automobile and includes a telescoping frame 1 and a lightweight covering 2 made of lightweight polyester especially treated such as "Mylar" made by DuPont, "Capton", "Astrolon" THERMxxGLO made by Metalized Products Division, King Sales Thermal Company.

Each brace of the telescoping frame 1 includes a base tube 3 which is of sufficient size to accommodate a series of interlocking tubes 4 telescoped therein. The interlocking tubes 4 are sequentially of smaller diameter so that each fits into the next interlocking tube and ultimately all the telescoped tubes fit into the base tube 3.

The interlocking between the tubes is accomplished by a male locking member 6 at the base end of each tube 4 which is threaded and fits into the interiorly threaded end of the next larger tube. When threaded end is turned on a reversed thread in the adjacent larger tube, it locks tubes in the extended position but when turned with the thread then it passes the thread inwardly and allows the smaller tube to be telescoped into the next larger tube.

In order to render the extended frame flexible so as to assume substantially arcuate support spaced from the surface of the body of the automobile, the tubes are made of flexible plastic or metal material.

The number of telescoping tubes is chosen according to the length of the particular automobile so that all size cars can be accommodated. Most frames in the present form will be operative with four extension tubes.

The base ends 8 of the base tubes 3 are connected to one another by a cross member 9 which has a hook 11 thereon that can be hooked over the rear bumper 12. The ends of the smallest tubes are connected to another cross member 13, on which are cables or chains 14 which can be played around the front bumper and can be secured by a padlock 17.

Figure 11:
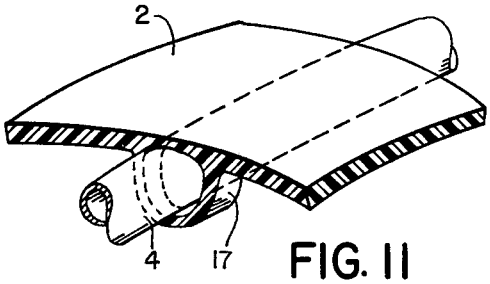
FIG. 11 is a fragmental view of the covering with a portion of a space element and a loop on the covering slidable over the element.
Figure 9:
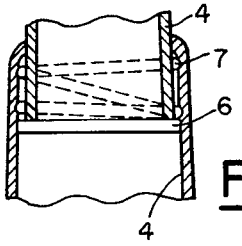
FIG. 9 is a fragmental view showing portions of the elements approaching interlocking position.
Figure 12:
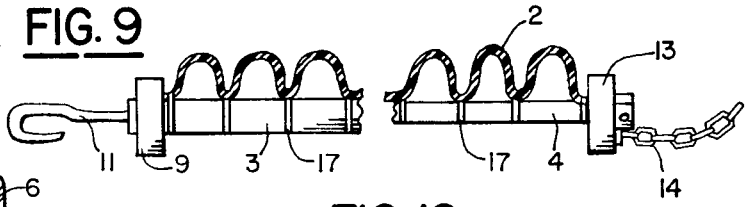
FIG. 12 is a partly sectional view showing the frame partially collapsed and the covering folded.
Figure 10:
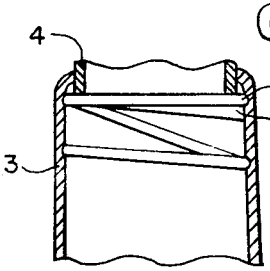
FIG. 10 is a fragmental view showing the adjacent ends of elements interlocked.

The solar shield material is held on the tubes by spaced loops 17 as shown in FIGS. 11 and 12, and at its ends secured to the cross members 9 and 13 so that it may be suitably folded when the supporting frame is collapsed.

Figure 5:
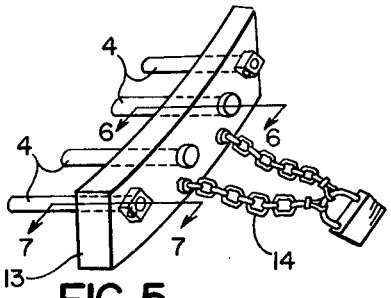
FIG. 5 is a perspective view of the locking end of the spacer frame.
Figure 6:
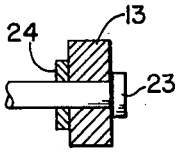
FIG. 6 is a fragmental partly sectional view of the securing end of a spacer element.
Figure 7:
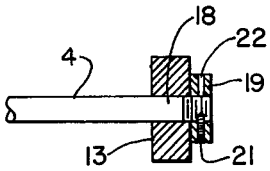
FIG. 7 is a fragmental sectional view of a spacer element.
Figure 8:
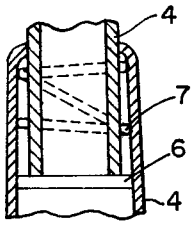
FIG. 8 is a fragmental view showing the locking means between telescoping elements in partially telescoped position.
Figure 13:
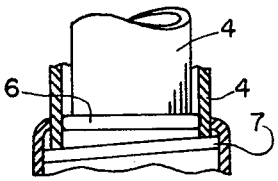
FIG. 13 is a fragmental view showing the interlock at the base of a larger tube with the smaller tube fully telescoped therein.

In the herein illustration only the outside braces are provided with the interlocking threads heretofore described. The free end of each outside smallest tube extends through a hole 18 in the front cross member 13 as shown in FIGS. 5 and 7. This free end extending through a hole 18 is threaded. A nut 19 is secured on the threaded end by a setscrew 21. Each nut 19 has a radial hole or socket 22 for engagement by a suitable tool such as a screwdriver for turning the nut and the respective outside tubes 4 therewith in sequence until all the threaded ends 6 of the tubes 4 are in locking engagement with the locking grooves or reversed threads 7 in the respective adjacent larger tubes. For telescoping, a similar interior thread 7 is provided in the base end of each tube 4 to be engaged by a male thread 6 as shown in FIG. 13 so that when a tube is telescoped into the next larger tube to the base and turned it will interlock so that further turning will also turn said next larger tube in sequence until all the smaller tubes are telescoped into the base tube 3.

Thus, by turning the tubes in sequence in the opposite direction to the previous locking turn, all the tubes are first unlocked and telescoped in sequence and then locked together, and the flexible sheet is folded or pleated whereby the unit becomes of such length that it can be stored in the trunk of an automobile. The ends of the smallest tubes of the middle braces are fixed in the cross member 13 by a fixed head 23 and by a collar 24 engaging the inner face of the cross member 13.

The solar shield herein will protect the areas under the covered portions of a vehicle. It will also protect the upholstery within the vehicle. The temperature of the interior of the vehicle covered by the herein solar shield will remain cooler than that in vehicles left in direct sunlight, thereby the necessity for air conditioning to reduce the interior temperature at start is obviated. The solar shield also reduces the accumulation of dust when the vehicle is parked. It also will protect to a certain extent against theft. The elimination of the need for air conditioning to reduce the temperature in the automobile when the automobile is started further decreases the rate of gasoline consumption, which saves fuel.

I claim:

1. The solar shield for a vehicle comprising a covering of foldable material characterized by capability of reflecting the heat of the sun, collapsible spacing means to space the said covering from the body of a vehicle to be covered, and securing means to secure said spacing means to the body of the vehicle, said collapsible spacing means comprising a plurality of transversely spaced braces, extending longitudinally of the shield, longitudinally telescoping flexible arcuate, sections forming each brace, and an element at each end of the spacing means to hold the respective adjacent ends of the outermost telescoping sections together.

2. The solar shield defined in claim 1, and releasable means to lock the respective telescoping tubes in extended position.

3. The solar shield specified in claim 1, and each of said longitudinal sections being flexible telescoping tubes, said means for connecting said sections being a transverse member connecting the bases of the largest tubes and another transverse member connecting the ends of the smallest tubes, and releasable interlocking means between said tubes interlocking said tubes in extended position.

4. The solar shield specified in claim 1, and each longitudinal section being flexible, in each brace one of said longitudinal sections being a base section, and the other telescoping sections telescoping into each other and into said base section, each section having an inner end nearer to said base section and an outer end farther from said base section, interlocking means between the outer end of each section and the inner end of each adjacent section for interlocking in extended position of said brace.

5. The solar shield specified in claim 4 and, releasable interlocking means between the outer ends of the respective sections and the adjacent inner ends of said respective sections for interlocking said sections in telescoped position.

6. The solar shield specified in claim 4, and said interlocking means comprising, a threaded interlocking element at the outer end of each base section, a threaded interlocking element at the inner end of each outermost section, each telescoping section between said base section and said outermost section having interlocking elements at both ends coacting with the adjacent interlocking elements whereby the interlocking elements on the inner ends of the telescoping sections coacting with the interlocking elements at the outer ends of the adjacent telescoping sections when turned in one direction to interlock and to turn said telescoping sections in sequence, and coacting with the inner end interlocking elements respectively when turned in the opposite direction for interlocking in sequence the said telescoping sections when telescoped.

* * * * *